US006978986B2

(12) United States Patent
Chang

(10) Patent No.: US 6,978,986 B2
(45) Date of Patent: Dec. 27, 2005

(54) CLAMPING DEVICE

(76) Inventor: Ching-Tsung Chang, No.60, Alley 215, Cheng Feng Lane, Tai Ming Rd., Wu Jih, Taichung (TW)

( * ) Notice: Subject to any disclaimer, the term of this patent is extended or adjusted under 35 U.S.C. 154(b) by 135 days.

(21) Appl. No.: 10/680,252

(22) Filed: Oct. 8, 2003

(65) Prior Publication Data

US 2005/0077667 A1 Apr. 14, 2005

(51) Int. Cl.[7] ..... B25B 1/02
(52) U.S. Cl. ..... 269/6
(58) Field of Search ..... 269/6, 3, 165–171.5, 269/147–150; 81/487; 259/106–111

(56) References Cited

U.S. PATENT DOCUMENTS 6,382,608 B1 * 5/2002 Michell ..... 269/6

* cited by examiner

*Primary Examiner*—Robert C. Watson
(74) *Attorney, Agent, or Firm*—Troxell Law Office, PLLC

(57) ABSTRACT

A clamping device has a transmission mechanism that includes upper and lower oblique cavities respectively provided above and below a scaled rod of the clamping device; a steel ball and a compression spring are sequentially positioned in each of the two oblique cavities, so that the steel balls are normally pushed forward by the compression springs to firmly contact with an inner front surface of the cavities, as well as upper and lower sides of the scaled rod, allowing the scaled rod to move rearward only when an operating handle of the clamping device is pivotally pulled. The steel ball in the lower cavity may be pushed backward to separate from the lower side of the scaled rod when a push button located in front of the lower cavity is pushed, so that the scaled rod is allowed to move forward.

7 Claims, 5 Drawing Sheets

CLAMPING DEVICE

FIELD OF THE INVENTION

The present invention relates to a clamping device, and more particularly to a clamping device, a transmission mechanism of which includes steel balls and compression springs to enable easy and effortless movement of a scaled rod of the clamping device to clamp or release work pieces to or from the clamping device.

BACKGROUND OF THE INVENTION

FIG. 1 shows a conventional clamping device generally available in the markets. The conventional clamping device includes a transmission mechanism in which an operating handle A is pivotally turned to incline a push member E behind the operating handle A. When the push member E is inclined, an opening B thereof engaging with a scaled rod D of the clamping device also inclines to firmly contact with, press against, and push the scaled rod D, which is fixedly connected at a distal end to a movable jaw C of the clamping device, so that the scaled rod D, and accordingly the movable jaw C, are linearly moved.

A disadvantage of the above-described transmission mechanism for the conventional clamping device is that the movement of the scaled rod D and the movable jaw C is achieved completely through pressing and pushing the inclined opening B against the scaled rod D. When the clamping device is subjected to relatively large load, a user has to hold and operate operating handle A with increased efforts. Moreover, the operating handle is made of a relatively rigid material that tends to cause a tired and sore hand after being operated over a long period of time.

It is therefore tried by the inventor to develop a clamping device having an improved transmission mechanism to eliminate the above-mentioned drawbacks existed in the conventional clamping device.

SUMMARY OF THE INVENTION

A primary object of the present invention is to provide a clamping device that has an improved transmission mechanism including steel balls and compression springs to enable elastic control of movements of a scaled rod of the clamping device through effortless operation of an operating handle thereof.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
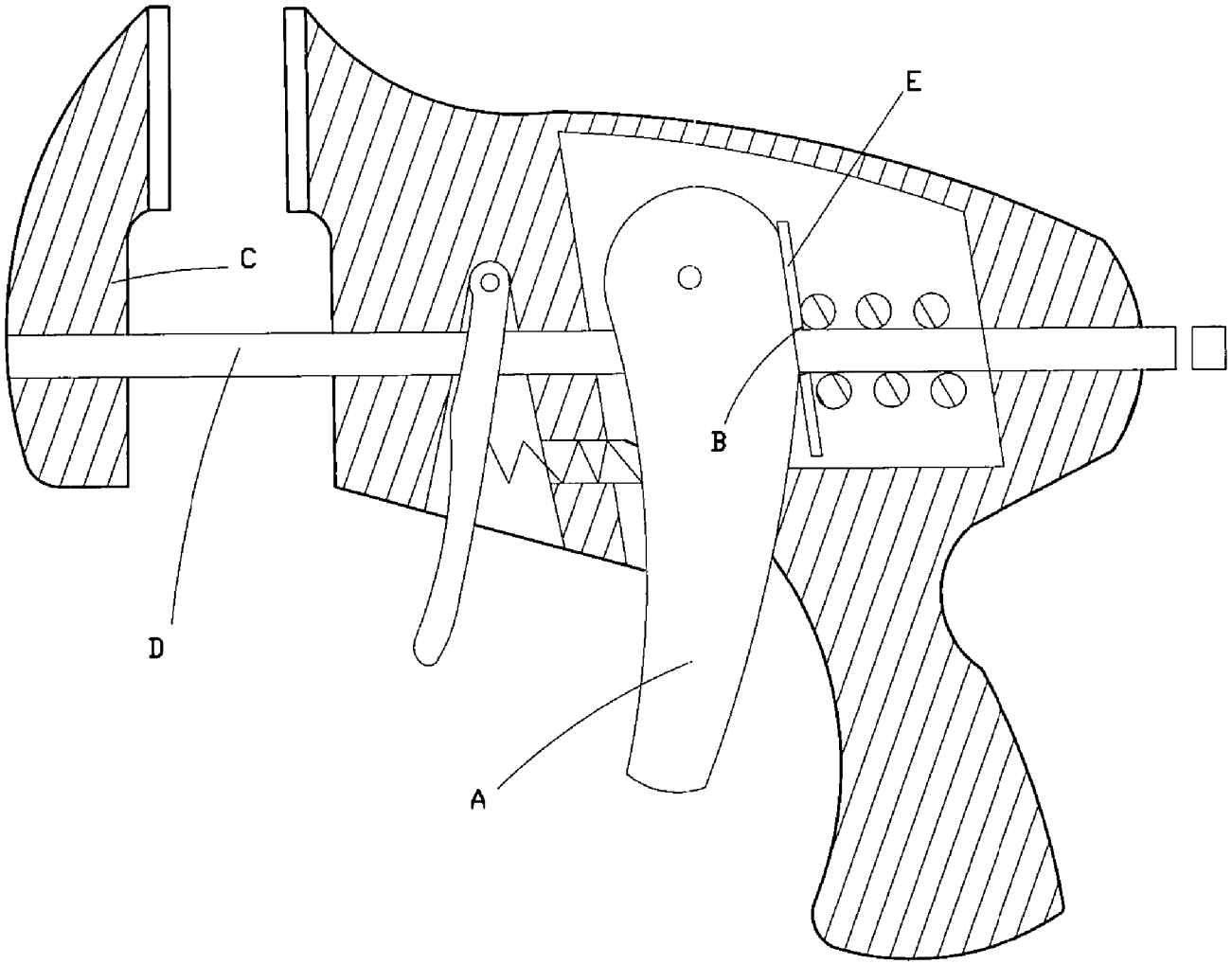
FIG 1 PRIOR ART
FIG. 1 is a sectioned side view of a conventional clamping device.
Figure 2:
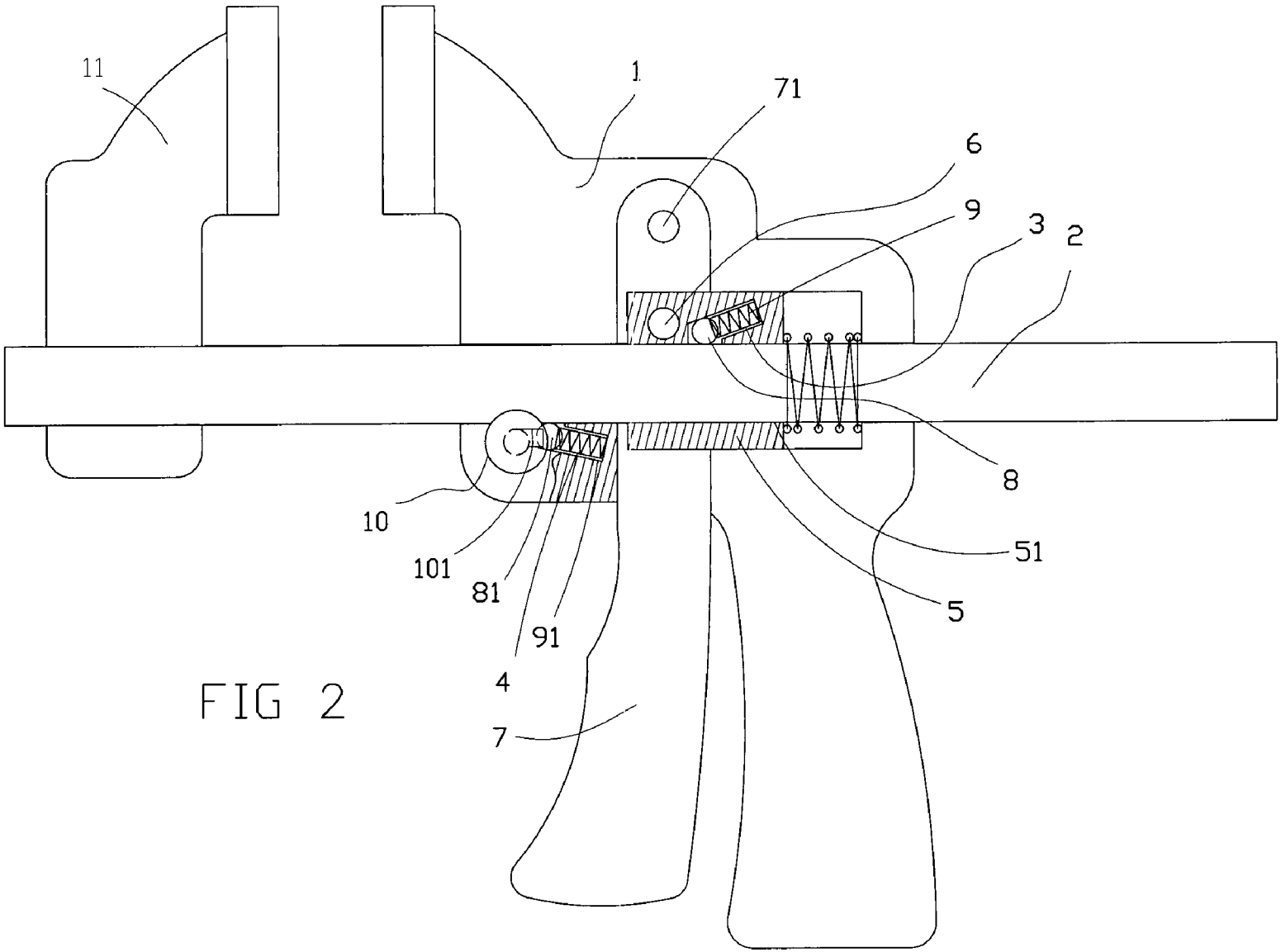
FIG. 2 is a sectioned side view of a clamping device according to the present invention.

Please refer to FIG. 2 that is a sectioned side view of a clamping device 1 according to the present invention. As shown, the clamping device 1 includes a scaled rod 2, a movable jaw 11 connected to a distal end of the scaled rod 2, an operating handle 7 pivotally connected at an upper end to the clamping device 1 via a supporting point 71, and a transmission mechanism for moving the scaled rod 2.

The transmission mechanism mainly includes a housing 5 having an internal passage 51. The scaled rod 2 is inserted into the internal passage and selectively movable in forward and rearward directions. The housing 5 is then pivotally fixed to the operating handle 7 with a rivet or screw 6. The screw 6 is located below the supporting point 71 of the operating handle 7. The housing 5 includes an upper cavity 3 communicating with the internal passage 51 and located above the scaled rod 2. The upper cavity 3 extending upwardly from the internal passage 51 in a predetermined rearwardly and upwardly direction, so that a lower open end of the upper cavity 3 is communicating with the internal passage 51. When the operating handle 7 is pivotally pulled backward, the housing 5 moves backward at the same time, and pivots relative to the operating handle 7. The transmission mechanism also includes a lower cavity 4 located in the clamping device 1 below the scaled rod 2 and in front of the upper cavity 3 by a predetermining distance. The lower cavity 4 is obliquely extended rearwardly and downwardly at a predetermined angle and has an upper open end. Both the upper and the lower cavity 3, 4 have a steel ball 8, 81 and a compression spring 9, 91 sequentially positioned therein, such that the steel balls 8, 81 are normally pushed forwardly by the compression springs 9, 91 to respectively contact with the upper and lower sides of the scaled rod 2, as well as inner surfaces of the open ends of the upper and lower cavities 3, 4. Due to the obliquely extended cavities 3, 4, the steel balls 8, 81 pushed forward by the compression springs 9, 91 to firmly press against the upper and lower sides of the scaled rod 2 allow the scaled rod 2 to move rearward but not forward. That is the forwardly pushed steel balls 8, 81 function like braking devices to prevent the scaled rod 2 from moving in the forward direction. When the operating handle 7 is pulled backward and the housing 5 moves backward at the same time by the operating handle 7, the scaled rod 2 inserted through the internal passage 51 of the housing 5 and tightly contacted with the steel balls 8, 81 is therefore moved backwardly with the housing 5.

Figure 3:
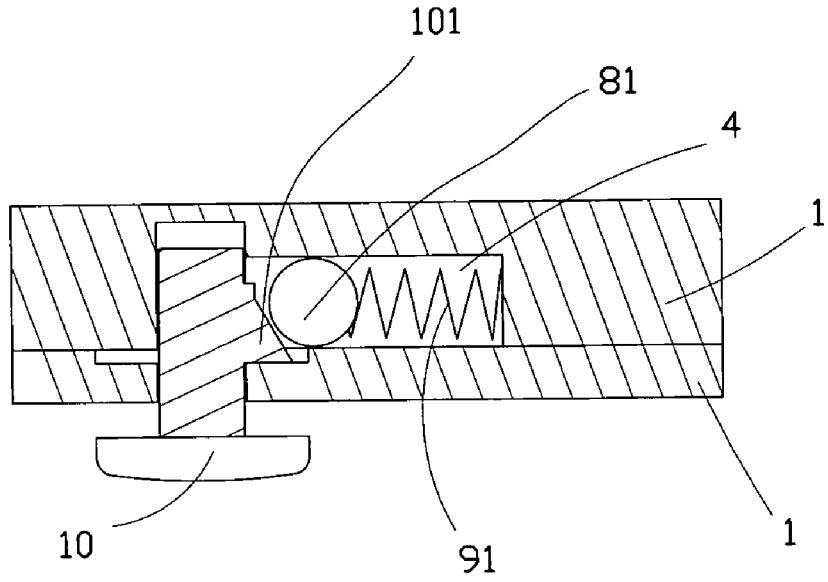
FIGS. 3 and 4 are sectioned side and top views, respectively, showing a push button on the present invention in a normal position.
Figure 4:
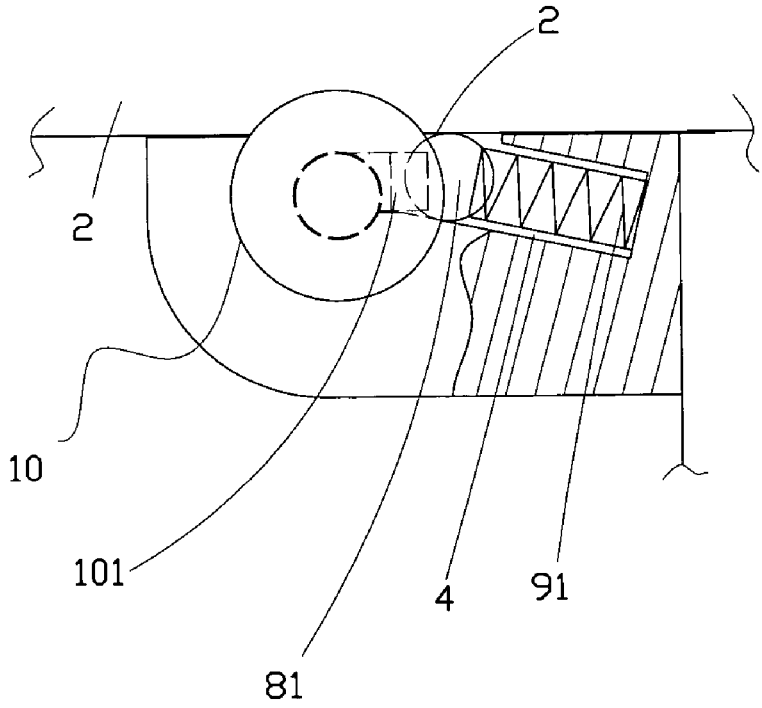
Figure 5:
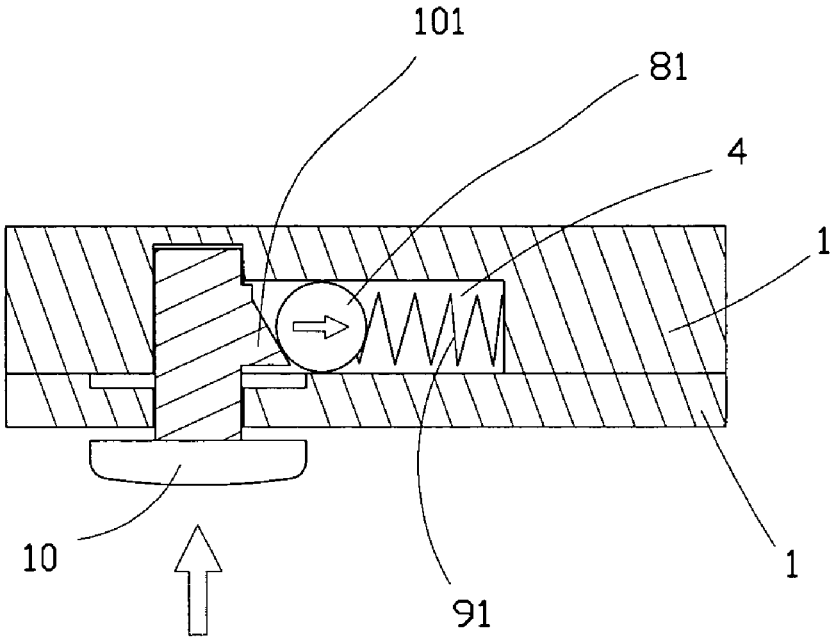
FIGS. 5 and 6 are sectioned side and top views, respectively, of the push button on the present invention in a depressed position.
Figure 6:
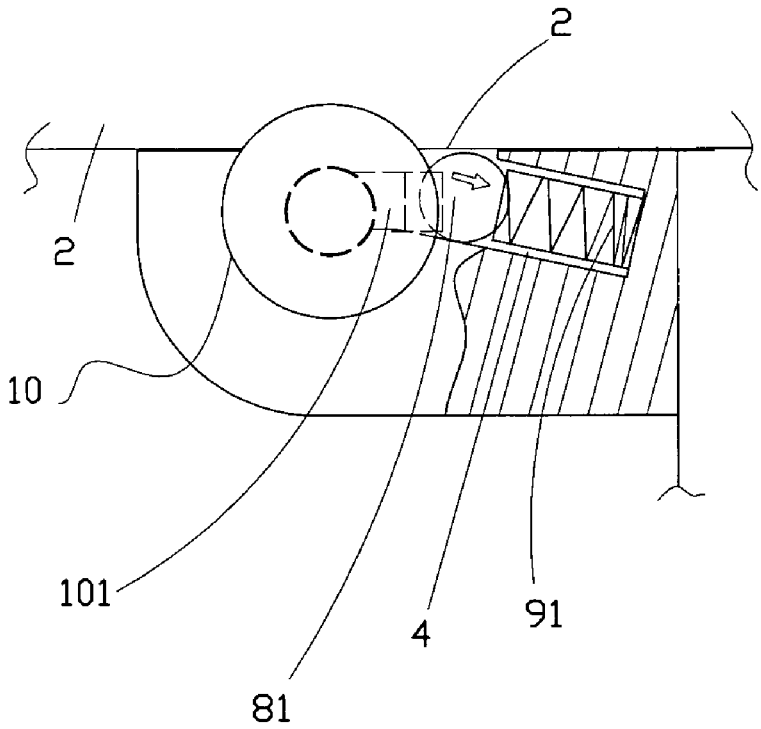

Please refer to FIGS. 2, 3, and 4. A push button 10 is closely provided in front of the open end of the lower cavity 4. The push button 10 includes an expanded head, a stem downward extended from the expanded head, and a projection 101 provided at a predetermined position on the stem and having a beveled lower surface. The push button 10 is so located that the beveled lower surface of the projection 101 is normally in contact with the steel ball 81, as shown in FIGS. 3 and 4. And, when the push button 10 is pushed, the beveled lower surface of the projection 101 pushes the steel ball 81 backward into the lower cavity 4, as shown in FIGS. 5 and 6, so that the steel ball 81 is separated from the lower side of the scaled rod 2 to release the latter from a braked state. That is, to allow the scaled rod 2 to move forward, simply push the push button 10 located below the scaled rod 2.

Figure 7:
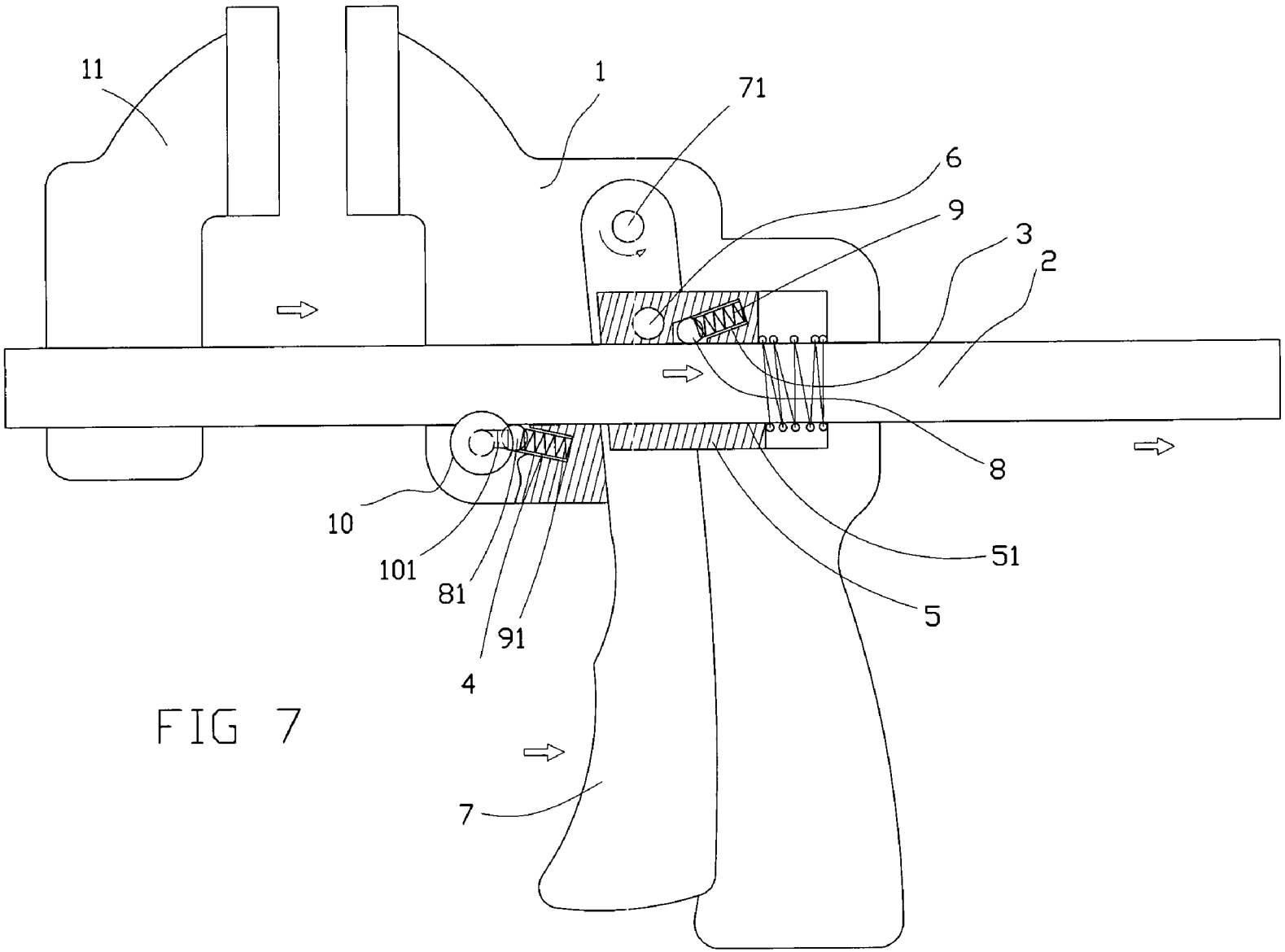
FIG. 7 is a sectioned side view showing the clamping device of the present invention when the operating handle thereof is pivotally pulled backward.

Please refer to FIG. 7 that explains the operation of the clamping device of the present invention. When the operating handle 7 is pivotally pulled, the steel ball 8 in firm contact with the upper side of the scaled rod 2 is caused to move the scaled rod 2 rearward, so that the movable jaw 11 connected to the distal end of the scaled rod 2 also moves rearward at the same time. And, when it is desired to move the movable jaw 11 forward to release work pieces (not shown) from the clamping device, simply push the push button 10 located below the scaled rod 2, and the beveled lower surface of the projection 101 on the downward extended stem of the push button 10 would push the steel ball 81 into the lower cavity 4 to separate from the lower side of the scaled rod 2, releasing the scaled rod 2 from the braked state and allowing the movable jaw 11 to move forward, as shown in FIGS. 5 and 6.

What is claimed is:

1. A clamping device comprising a scaled rod, a movable jaw connected to a distal end of said scaled rod, an operating handle pivotally connected at an upper end to said clamping device via a supporting point, and a transmission mechanism for moving said scaled rod and said movable jaw at the same time; said transmission mechanism including a housing that is pivotally fixed to said operating handle below said supporting point, and provided with an internal passage for said scaled rod to extend therethrough and an upper cavity obliquely extended from said internal passage in a predetermined rearward and upward direction to locate above said scaled rod, so that a lower open end of said upper cavity is communicating with said internal passage; and said transmission mechanism also including a lower cavity located in said clamping device below said scaled rod and in front of said upper cavity by a predetermined distance, and said lower cavity being obliquely extended rearward and downward at a predetermined angle and having an upper open end.

2. The clamping device as claimed in claim 1, further comprising an upper steel ball and an upper compression spring sequentially positioned in said upper cavity in said housing, so that said upper steel ball is normally pushed forward by said first compressing spring to press against an inner surface of said lower open end of said upper cavity and an upper scale of said scaled rod.

3. The clamping device as claimed in claim 1, further comprising a lower steel ball and a lower compression spring sequentially positioned in said lower cavity.

4. The clamping device as claimed in claim 3, further comprising a push button located in front of said lower cavity.

5. The clamping device as claimed in claim 4, wherein said push button includes an expanded head, a stem downward extended from said expanded head into said clamping device, and a projection provided at a predetermined position on said stem; and said projection having a beveled lower surface that is normally in contact with said second lower steel ball in said lower cavity.

6. The clamping device as claimed in claim 3, wherein said lower steel ball is normally pushed forward by said lower compressing spring to press against an inner surface of said upper open end of said lower cavity, and a lower side of said scaled rod.

7. The clamping device as claimed in claim 5, wherein said lower steel ball is normally pushed forward by said lower compressing spring to press against an inner surface of said upper open end of said lower cavity, a lower side of said scaled rod, and said beveled lower surface of said projection of said push button.

* * * * *